US006238297B1

(12) United States Patent
Tilton

(10) Patent No.: US 6,238,297 B1
(45) Date of Patent: May 29, 2001

(54) BOWLING BALL THUMB SLEEVE

(76) Inventor: James Tilton, 38448 20th St. E., Palmdale, CA (US) 93550

( * ) Notice: Subject to any disclaimer, the term of this patent is extended or adjusted under 35 U.S.C. 154(b) by 0 days.

(21) Appl. No.: 09/511,402

(22) Filed: Feb. 23, 2000

Related U.S. Application Data

(60) Provisional application No. 60/121,606, filed on Feb. 25, 1999.

(51) Int. Cl.[7] ..... A63B 43/02
(52) U.S. Cl. ..... 473/128; 473/130
(58) Field of Search ..... 473/127, 128, 473/129, 130

(56) References Cited

U.S. PATENT DOCUMENTS 5,007,640 * 4/1991 Bernhardt .
5,176,378 * 1/1993 Bernhardt .
5,308,061 * 5/1994 Bernhardt .

* cited by examiner

*Primary Examiner*—William M. Pierce
(74) *Attorney, Agent, or Firm*—Roger A. Marrs

(57) ABSTRACT

A bowling ball thumb sleeve provides an elongated sleeve having a cylindrical wall thickness composed of a yieldable material that defines an open-ended passageway adapted to insertably receive the thumb of the bowler via either end of the sleeve as opposed to the sole opening of a finger insert. Each open end of the passageway is defined by a geometric shape or configuration at the time of sleeve usage in the bowling ball hole. The sleeve provides for at least one pad or wedge-shaped thickened portion at least at one entrance to the passageway and such may be present at both entrances. An example of an entrance shape may be oval, round or elliptical and the improved sleeve provides for a combination of these geometric shapes. The thumb sleeve is elongated and of a length greater than the length of a bowling ball hole and the player may select the entrance opening shape and ramp thickness followed by severing and removing the opposite end which then may be discarded. The selected portion is inserted into the bowling ball hole and will be of the proper length and expose the desired opening entrance shape.

4 Claims, 1 Drawing Sheet

BOWLING BALL THUMB SLEEVE

Priority claimed on Ser. No. 60/121,606 filed Feb. 25, 1999

BACKGROUND OF THE INVENTION

1. Field of the Invention

The present invention relates to the field of athletic equipment, and more particularly to a novel sleeve for placement on the thumb of a player when a bowling ball is tossed or delivered by the player towards a set of bowling pins to gain better control of the ball.

2. Brief Description of the Prior Art

It has been a conventional practice to control the throw or toss of a bowling ball by a player through the use of soft, pliable inserts which are placed into selected finger holes in a bowling ball. The inserts are not worn by the player. By the employment of pads or wedge-shaped portions within the insert, the frictional engagement is increased between the fingertip of the player and the ball at certain times during the bowler's swing whereby the ultimate path of travel of the ball is controlled. In the use of such inserts, the pads or wedge-shaped portions must not interfere with the release of the bowling ball at the end of the player's toss or throw.

Some attempts have been made to employ pads and wedge-shaped portions which are shown and described in U.S. Pat. Nos. 4,585,230; 5,123,644; 5,007,640 and 4,890,836. Although the disclosure of inserts for finger holes in bowling balls exists in prior patents, difficulties and problems have been encountered which stem largely from the fact that the player's choice of insert must be selected from a plurality of inserts having different pad locations or pad thicknesses. Also, there is more to ball control than the placement or use of pads, such as the shape of the entrance leading into the insert. Those disclosed are limited to round entrances leading into the pad or wedge-shaped thickened portions and round holes are not necessarily effective when the player is attempting to achieve power lifting, requirement for extra rotation or desires to maintain fingers within the insert for extended rotation. Also, the conventional insert grips are employed as single-side or ended inserts or grips without the option to employ the opposite side or end of the grip for a different feel or control purpose. Therefore, a multiplicity of individual inserts is required to be at the disposal of the bowler so that he may select a particular insert. This requires the bowler to procure and maintain the multiplicity of inserts and the loss of the inserts is quite common. Comfort is also important to the bowler and being limited to one shape is restrictive and not comfortable to all bowlers.

Prior finger inserts are not used for the player's thumb and there in particular as there is no known thumb insert on the market that is two-sided offering the player with a choice of different bores. Prior finger inserts are used on selected fingers of the player while the same inserts are not used on the player's thumb. For thumb usage, a sleeve is envisaged rather than an insert.

Therefore, a long-standing need has existed to provide a novel sleeve for a bowler's thumb which permits the bowler to select either end of the sleeve for thumb insertion and which provides more than one entrance shape to the sleeve bore that may be selected for comfort and ball control. Such a sleeve should take into account ball control purposes such as power lift shape and grip extension for longer or extended ball rotation purposes. To eliminate the necessity of having a multiplicity of different available sleeves to choose from, the various end openings and pad options may be combined into a single sleeve. The player can alter the sleeve by removing undesired portions of the sleeve in order to suit himself.

SUMMARY OF THE INVENTION

Accordingly, the improved bowling ball thumb sleeve of the present invention provides an elongated sleeve having a cylindrical wall thickness composed of a semi-rigid material that defines an open-ended passageway adapted to insertably receive the thumb of the bowler via either end of the sleeve as opposed to the sole opening of a finger insert. Each open end of the passageway is defined by a geometric shape different from the shape at its opposite end so that the bowler has a selection of either geometric shape or configuration at the time of sleeve usage in the bowling ball hole. A characteristic of the inventive sleeve provides for at least one pad or wedge-shaped thickened portion at an entrance to the passageway and it is contemplated that such a pad or wedge-shaped thickened portion may be present at both entrances to the interior of the passageway. An example of an entrance shape may be oval, round or elliptical and the improved sleeve provides for a combination of these geometric shapes at the opposite end entrances connected by the passageway. The inventive thumb sleeve is elongated and of a length greater than the length of a bowling ball hole. Thereby, the player may select the insert entrance opening shape and ramp thickness followed by severing and removing the opposite end which then may be discarded. The selected or remaining portion is inserted into the bowling ball hole and will be of the proper length and expose the desired opening entrance shape.

At least one score line is provided on the exterior surface of the sleeve serving as a guide for cutting or severing the sleeve into two parts so that the undesirable part may be discarded.

Therefore, it is among the primary objects of the present invention to provide a dual-ended thumb sleeve having one or more finger pads or wedge-shaped thickness portions as well as being combined with different entrance shapes to opposite ends of the sleeve.

Another object of the present invention is to provide a dual-ended thumb sleeve which includes entrances to a common passageway from opposite ends of the sleeve body which combine arrangements of thickened pads as well as entrance shapes so as to improve ball control as the ball is delivered to a set of pins during the course of playing the game of bowling.

Another object of the present invention is to provide a bowling ball thumb sleeve having an elongated passageway with open ends wherein one end is oval shaped so as to be designed for comfort and better rotation and which provides a better feel for comfort while allowing the thumb to stay in the ball for a more definite period of time.

A further object of the present invention is to provide a single bowling ball thumb sleeve with an oval shape at one end for comfort purposes permitting the thumb to remain longer in the ball and which provides a power lift shape for extending the grip length in the passageway by providing extra material taking the form of a pad located adjacent to the opposite entrances to the passageway and wherein the extra material permits extra rotation of the ball during delivery because of pitch or degree of angle designed in the sleeve grip.

Yet another object of the present invention is to provide a single combination bowling ball thumb sleeve having an internal passageway with opposite ends defining entrances into the passageway of different shapes and sizes so that the player has a choice of thumb insertion through one end or the other depending on type of ball delivery desired.

Furthermore, an object resides in providing an oversized sleeve, in length, having different shaped entrances leading into opposite ends of a passageway and having visible score lines on the exterior surface indicating severance locations for removal of an undesired or non-selected end of the sleeve.

Also, a thumb sleeve is provided presenting a bowler with options to remove either end of the sleeve so as to discard a non-selected end leaving only a selected end for thumb insertion.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood with reference to the following description, taken in connection with the accompanying drawings in which:

DESCRIPTION OF THE PREFERRED EMBODIMENT

Figure 1:
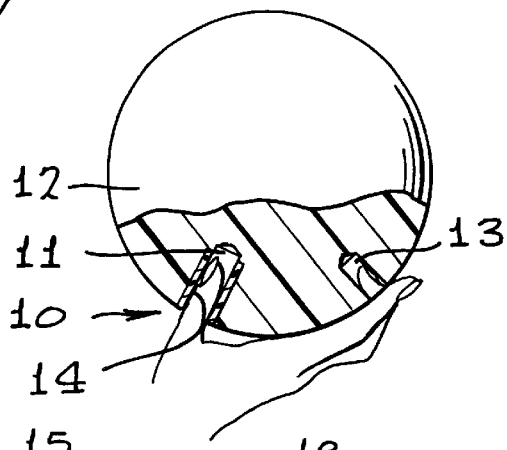
FIG. 1 is a front elevational view, partly in section, of a conventional bowling ball illustrating a selected end of the inventive bowling ball thumb sleeve installed in the thumb hole.

Referring to FIG. 1, the novel bowling ball thumb sleeve incorporating the present invention is indicated in the direction of arrow 10 and the sleeve is illustrated as having been cut to leave a selected end or portion for insertion within a thumb hole 11 drilled into a conventional bowling ball 12. The bowler's thumb is illustrated as being inserted into the sleeve 10 while the bowler's finger is inserted into a finger hole 13. The bowling ball is constructed of a rigid and hard material, such as vinyl, plastic or the like. However, the material is not as soft as for a finger insert. It can be seen that the bowler's thumb is inserted into an open-ended passageway 14 within the sleeve 10 and that the passageway is partially occupied by the user's thumb.

Figure 2:
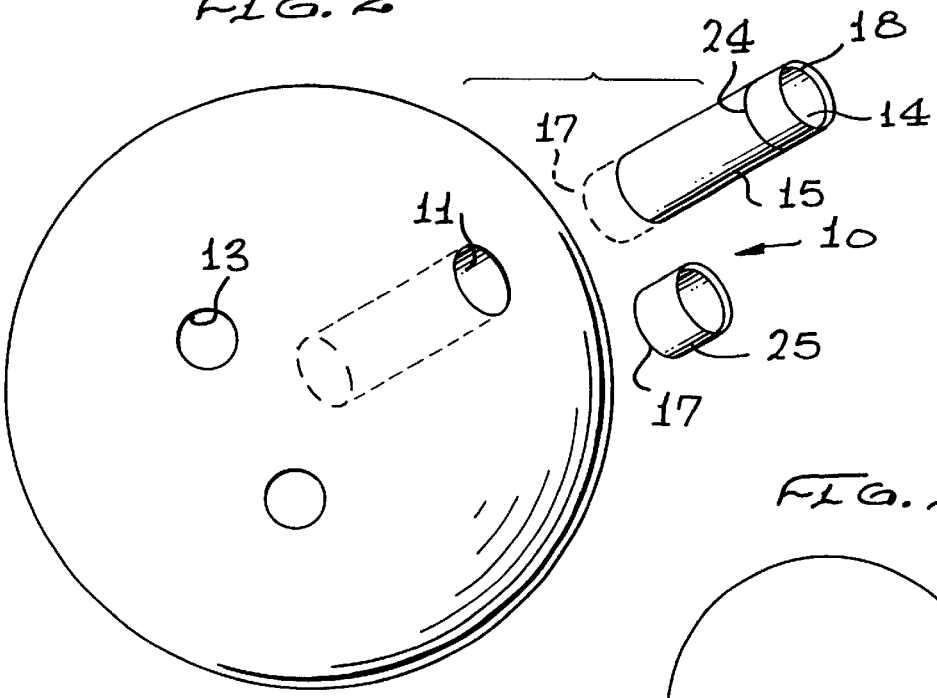
FIG. 2 is an enlarged perspective view of a bowling ball showing the selected end of the thumb sleeve preparatory for installation into a ball thumb opening.
Figure 4:
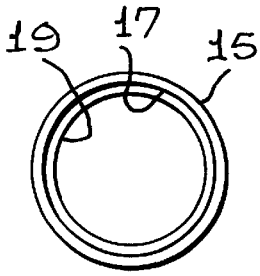
FIG. 4 is an end view of the sleeve illustrating a round shape at the entrance to one end of the passageway.
Figure 3:
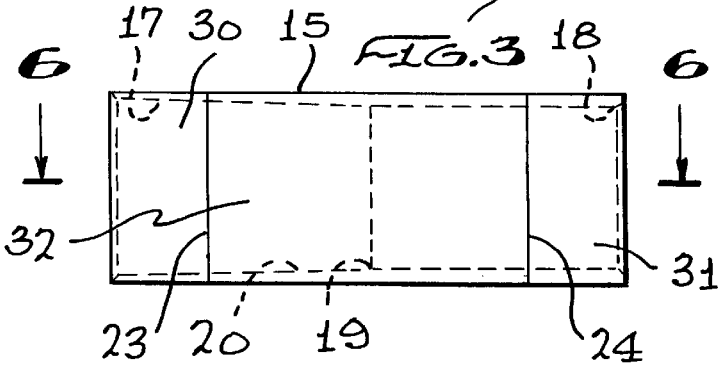
FIG. 3 is a side elevational view of the sleeve incorporating the present invention.
Figure 5:
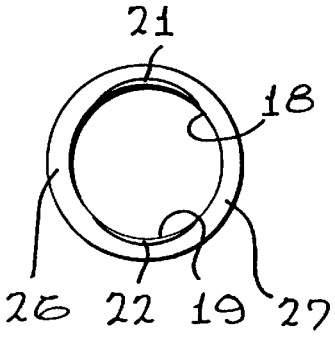
FIG. 5 is an end view of the other end of the sleeve illustrating an oval or elliptical shape at the entrance to the other end of the passageway.

Referring now in detail to FIG. 2, the novel sleeve 10 comprises an elongated open-ended tube or sleeve 15 having a wall thickness and which is of a cylindrical configuration which defines the open-ended passageway 14 while the opposite end of the passageway terminates in a second entrance 18 leading into the passageway as illustrated in FIG. 3. The entrance 17 may be configured to a geometric round shape, as shown in FIG. 4, while the entrance 18 is a geometric oval shape, as shown in FIG. 5.

It can also be seen that the entrance 17 to the passageway 14 further includes a tapered hole leading in decreasing diameter to a center 19 of the passageway and the slope is represented by the numeral 20. The wall of the tapered hole is composed of the same composition as that of the sleeve 15. The presence of the tapered slope 20 reduces the size of the hole from the entrance 17 into the passageway 14 and then the passageway continues to terminate in the oval entrance 18. The thickness of the wall at entrance 18 is substantially constant and is thicker than the thickness of the wall at entrance 17 due to the reduced thickness at areas or portions 21 and 22 shown in FIG. 5.

Inasmuch as the control of a bowling ball can be influenced by the shape of the entrance to the passageway as well as by the presence of the taper in the passageway, the player has an opportunity to select which end of the sleeve he desires to have exposed through the hole 11 in order to receive insertion of the thumb. The outside diameter of the sleeve 15 is such as to provide an interference fit with the sidewall of the hole 11 when the sleeve is forcibly inserted therein. Also, the length of the sleeve is readily accommodated by sizing the length of the sleeve so that none of the sleeve will protrude beyond the entrance to the hole 11. The sleeve is intentionally longer than the hole 11 so that once the player has selected exposure of either entrance 17 or 18, the non-selected end may be removed.

The sleeve 15 is provided with score lines 23 and 24 on the exterior surface wherein each score line is in fixed spaced-apart relationship with respect to entrances 17 and 18. Once the player has selected which of the two entrances or openings he desires, the non-elected entrance can be removed by cutting along the adjacent score line so that the non-elected end or portion 25 of the sleeve can be separated from the remaining sleeve, as shown in FIG. 1. Now the remaining sleeve can be installed into hole 11. Therefore, a single sleeve provides at least two different openings from which the player may choose his preference. The sleeve 15 includes a central section 32 with removable or separable end portions or sections 30 and 31, as shown in FIGS. 3 and 6.

It can be seen that the passageway 14 is open-ended terminating in entrances 17 and 18 at opposite ends of the sleeve 15. The sidewall 16, shown in FIG. 6, of the sleeve is of sufficient thickness to provide a comfortable feel to the player when the thumb is inserted into the passageway 14. The material is accommodating to thumb size and is depressible to receive any differences in thumb sizing between one player to another.

Figure 6:
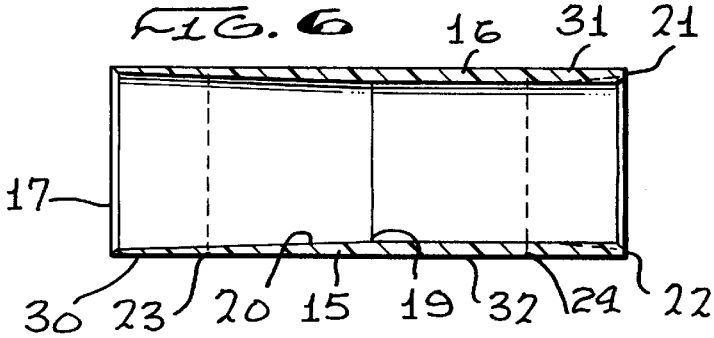
FIG. 6 is a longitudinal cross-sectional view of the inventive sleeve as taken in the direction of arrows 6—6 of FIG. 3.

FIG. 6 illustrates that the edge leading into the respective entrances 17 and 18 are champfered to easy finger insertion. However, entrance 18 is oval defined by reduced top and bottom wall thickness at numerals 21 and 22, as in FIG. 5 as well as regular side or lateral wall thicknesses 26 and 27.

However, the main feature resides in opposite end portions 30 and 31 that may be selectively removed at the election of the player. Lines marked on the external sleeve surface may be used as guides in separating the undesired portion or score or recessed lines may be employed for indicating the proper area to cut. The remaining length of sleeve is now sized to fit the length of the hole 11.

In view of the foregoing, it can be seen that the dual-ended thumb sleeve of the present invention provides for a combination of entrance openings of different geometric shapes. Entrance 18 may be of an oval shape designed for comfort and better rotation of the ball due to the feel of the sleeve composition which allows the thumb to stay in the ball. With respect to entrance 17, a power lift shape in the form of a round geometric configuration is employed so as to extend the grip length in the passageway. Therefore, the player utilizing the inventive grip of the present invention has multiple uses of the grip which conventionally would require a multiplicity of separate and individual grips. The inventive sleeve or grip is of unitary construction and the specialized entrance geometric configurations carried in a single unitary component with either end is adapted to be separated from the major length.

It is emphasized that the inventive concept relates only to the thumb and not to finger inserts. At present, there is no thumb sleeve or insert on the market that is double-ended or two-sided. Unlike finger inserts that are very soft, their purpose is to keep the player's fingers in the ball longer in time for more rotation on the bowling ball.

The two-sided or double-ended thumb sleeve is useful in many ways. The oval shape on one end is designed for comfort and overall shape of the average thumb. End two with its tapered end (smaller in the middle and tapering to a larger opening at the end) is for quick release and allows for a good fit while the player's thumb is positioned completely in the ball. However, as the player starts his release, more room is available for the thumb which creates less drag as the player's thumb leaves the sleeve so as to leave quicker.

The two-ended sleeve improves inventory control for a pro shop or the distributor. Instead of stocking both end shapes separately, the inventive sleeve can be stocked so as to have both shapes to choose from combined in a single product. The inventive sleeve provides a combination thumb sleeve in one structure having multiple purposes. The single body construction includes the score lines as well as the shaped passageway or bore.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

What is claimed is:

1. A bowling ball thumb sleeve insert comprising:

an elongated sleeve composed of a resilient, pliable material and having opposite ends;

said sleeve having a cylindrical thickened wall defining an open-ended passageway wherein each respective end defines an entrance leading into said passageway;

each of said entrances having a different geometric configuration from each other;

a resilient and pliable pad integrally disposed in said passageway immediately adjacent to at least one of said entrances;

one of said entrances is provided with an oval geometric configuration and the other of said entrances is provided with a round geometric configuration;

a selected one of said opposite ends adapted to be severed from said sleeve leaving a non-selected end available to insertably receive the thumb of the user; and a pair of score lines provided on the external surface of said sleeve in fixed spaced-apart relationship, each of said score lines of said pair carried adjacent to a respective end of said sleeve opposite ends.

2. The thumb sleeve defined in claim 1 wherein:

said passage is a bore defined by an internal wall surface of said sleeve;

said bore having a diverging tapering surface extending from a midway section between said opposite ends to said circular entrance and further having a circular surface of constant diameter extending from said midway section to said oval entrance.

3. The thumb sleeve defined in claim 2 including:

a shoulder provided in said bore at said midway portion of said sleeve separating said diverging tapering surface and said circular surface.

4. The thumb sleeve defined in claim 3 wherein:

said sleeve cylindrical thickened wall is reduced in thickness at said pair of score lines to weaken said cylindrical thickened wall promoting severing of either said selected or said non-selected one of said ends.

* * * * *